US011512447B2

(12) United States Patent
Myers et al.

(10) Patent No.: US 11,512,447 B2
(45) Date of Patent: Nov. 29, 2022

(54) SYSTEMS AND METHODS TO IMPROVE WORK MACHINE STABILITY BASED ON OPERATING VALUES

(71) Applicant: Deere & Company, Moline, IL (US)

(72) Inventors: David Myers, Dubuque, IA (US); Doug Lehmann, Bellevue, IA (US)

(73) Assignee: DEERE & COMPANY, Moline, IL (US)

( * ) Notice: Subject to any disclaimer, the term of this patent is extended or adjusted under 35 U.S.C. 154(b) by 625 days.

(21) Appl. No.: 16/182,106

(22) Filed: Nov. 6, 2018

(65) Prior Publication Data

US 2020/0141088 A1 May 7, 2020

(51) Int. Cl.

| | |
|---|---|
| ***E02F 9/22*** | (2006.01) |
| ***E02F 9/20*** | (2006.01) |
| ***E02F 3/28*** | (2006.01) |
| ***E02F 9/08*** | (2006.01) |
| ***E02F 3/42*** | (2006.01) |
| ***E02F 3/43*** | (2006.01) |

(52) U.S. Cl.

CPC ..... *E02F 9/2033* (2013.01); *E02F 3/283* (2013.01); *E02F 3/422* (2013.01); *E02F 3/431* (2013.01); *E02F 9/0841* (2013.01); *E02F 9/2203* (2013.01); *E02F 9/225* (2013.01)

(58) Field of Classification Search

CPC ..... E02F 9/2033; E02F 9/0841; E02F 9/225; E02F 9/2203; E02F 3/283; B66F 17/00

See application file for complete search history.

(56) References Cited

U.S. PATENT DOCUMENTS

| | | | |
|---|---|---|---|
| 5,180,028 | A | 1/1993 | Perrenoud, Jr. |
| 5,692,376 | A | 12/1997 | Miki et al. |
| 6,047,228 | A | 4/2000 | Stone et al. |
| 6,175,796 | B1 | 1/2001 | Ishikawa |
| 6,437,701 | B1 | 8/2002 | Muller |

(Continued)

FOREIGN PATENT DOCUMENTS

| | | | |
|---|---|---|---|
| CC | 103403271 | A | 11/2013 |
| CN | 103026076 | A | 4/2013 |

(Continued)

OTHER PUBLICATIONS

U.S. Appl. No. 15/908,574, filed Feb. 28, 2018, by Kenkel et al.

(Continued)

*Primary Examiner* — Frederick M Brushaber
*Assistant Examiner* — Matthew J. Reda
(74) *Attorney, Agent, or Firm* — Michael Best and Friedrich LLP

(57) ABSTRACT

A work machine includes systems and methods for stability control based on operating values. The work machine includes a control system having a sensor system with a load sensor, an arm position sensor, and an articulation angle sensor. A controller is in communication with the sensor system. The controller is configured to receive a movement command and to receive a set of values from the sensor system. The controller is configured to determine an operational window for normal operation of the work vehicle based on the received set of values, determine a movement limit based on the received set of values, and limit movement of a component beyond the movement limit.

20 Claims, 11 Drawing Sheets

(56) References Cited

U.S. PATENT DOCUMENTS

| | | | | |
|---|---|---|---|---|
| 6,552,279 | B1 | 4/2003 | Lueschow | |
| 6,615,581 | B2 | 9/2003 | Kusuyama | |
| 6,766,236 | B1 * | 7/2004 | Lamela | E02F 9/2296 701/50 |
| 6,802,687 | B2 | 10/2004 | Litchfield et al. | |
| 6,868,672 | B2 | 3/2005 | Luo | |
| 7,276,669 | B2 | 10/2007 | Dahl et al. | |
| 7,518,523 | B2 | 4/2009 | Yuan et al. | |
| 7,610,136 | B2 | 10/2009 | Okamura et al. | |
| 7,630,793 | B2 | 12/2009 | Thomas et al. | |
| 8,751,117 | B2 | 6/2014 | Ekvall et al. | |
| 9,068,323 | B2 | 6/2015 | Peterson et al. | |
| 9,074,352 | B2 | 7/2015 | Ramun | |
| 9,206,026 | B2 | 12/2015 | Aulton et al. | |
| 9,238,903 | B2 | 1/2016 | Saito | |
| 9,593,461 | B2 | 3/2017 | Faivre et al. | |
| 9,822,507 | B2 | 11/2017 | Singh et al. | |
| 2006/0108185 | A1 | 5/2006 | Bitter | |
| 2008/0201043 | A1 | 8/2008 | Sahlin et al. | |
| 2008/0234902 | A1 | 9/2008 | Johnson et al. | |
| 2009/0082930 | A1 | 3/2009 | Peters | |
| 2009/0171482 | A1 | 7/2009 | Mindeman et al. | |
| 2010/0204891 | A1 | 8/2010 | Biggerstaff | |
| 2010/0268410 | A1 | 10/2010 | Vigholm et al. | |
| 2011/0046857 | A1 | 2/2011 | Farmer et al. | |
| 2012/0291427 | A1 | 11/2012 | Azuma et al. | |
| 2012/0330515 | A1 * | 12/2012 | Numazaki | F15B 11/048 701/50 |
| 2013/0226415 | A1 * | 8/2013 | Smith | E02F 9/2235 701/50 |
| 2013/0228070 | A1 | 9/2013 | Kim | |
| 2013/0297155 | A1 * | 11/2013 | Ekvall | F15B 21/087 701/50 |
| 2013/0318952 | A1 * | 12/2013 | Park | B60W 30/1886 60/327 |
| 2013/0345939 | A1 * | 12/2013 | Magaki | E02F 3/435 701/50 |
| 2014/0088839 | A1 | 3/2014 | Magaki et al. | |
| 2014/0121840 | A1 | 5/2014 | Mizuochi et al. | |
| 2014/0320293 | A1 | 10/2014 | Hunter, Jr. et al. | |
| 2015/0368080 | A1 | 12/2015 | Dal Dosso et al. | |
| 2016/0281323 | A1 | 9/2016 | Imaizumi | |
| 2016/0281331 | A1 | 9/2016 | Ikegami et al. | |
| 2016/0312432 | A1 | 10/2016 | Wang et al. | |
| 2017/0050643 | A1 | 2/2017 | Lambert | |
| 2017/0121929 | A1 | 5/2017 | Martinez | |
| 2017/0191245 | A1 | 7/2017 | Shatters et al. | |
| 2017/0211597 | A1 | 7/2017 | Vigholm et al. | |
| 2017/0284056 | A1 | 10/2017 | Mizuochi et al. | |
| 2018/0087242 | A1 * | 3/2018 | Mitchell | B62D 6/02 |
| 2018/0327238 | A1 * | 11/2018 | Tremblay | E02F 3/4133 |
| 2019/0010965 | A1 | 1/2019 | Green et al. | |
| 2019/0024345 | A1 | 1/2019 | Thomsen et al. | |

FOREIGN PATENT DOCUMENTS

| | | | |
|---|---|---|---|
| CN | 105035776 | A | 11/2015 |
| CN | 106245706 | A | 12/2016 |
| CN | 107268702 | A | 10/2017 |
| DE | 19510375 | A1 | 9/1995 |
| DE | 19901563 | A1 | 7/2000 |
| DE | 10163066 | A1 | 7/2003 |
| DE | 102007045846 | A1 | 4/2009 |
| DE | 102008012301 | A1 | 9/2009 |
| DE | 112010003335 | T5 | 8/2012 |
| DE | 112012003346 | B4 | 1/2017 |
| EP | 0229083 | B1 | 7/1987 |
| EP | 1862599 | B1 | 7/2013 |
| JP | H03-8929 | A | 1/1991 |
| WO | 2014110336 | A1 | 7/2014 |
| WO | 2016152994 | A1 | 7/2017 |

OTHER PUBLICATIONS

U.S. Appl. No. 15/908,555, filed Feb. 28, 2018, by Myers et al.
U.S. Appl. No. 15/908,581, filed Feb. 28, 2018, by Henn et al.
U.S. Appl. No. 15/908,583, filed Feb. 28, 2018, by Lehmann et al.
U.S. Appl. No. 15/908,561, filed Feb. 28, 2018, by Kenkel et al.
U.S. Appl. No. 15/908,565, filed Feb. 28, 2018, by Myers et al.
German Patent Office Examination Report for Application No. 102019202654.0 dated Dec. 18, 2019 (11 pages, statement of relevance included).
German Patent Office Examination Report for Application No. 102019202754.7 dated Dec. 20, 2019 (11 pages, statement of relevance included).
Hassan et al. "An Experimental Study Into The Effect of Temperature and Pressure on the Hydraulic System" Eng. & Tech. Journal, 2009, 27(14):12531-2545.
German Patent Office Examination Report for Application No. 102019202746.6 dated Jan. 29, 2020 (11 pages, statement of relevance included).
Chinese Office Action for Application No. 201910155022.8 dated Nov. 10, 2021 (13 pages).
Chinese Office Action for Application No. 201910154611.4 dated Dec. 13, 2021 (13 pages).

* cited by examiner

SYSTEMS AND METHODS TO IMPROVE WORK MACHINE STABILITY BASED ON OPERATING VALUES

FIELD

The disclosure relates to a hydraulic system for a work vehicle.

BACKGROUND

Many industrial work machines, such as construction equipment, use hydraulics to control various moveable implements. The operator is provided with one or more input or control devices operably coupled to one or more hydraulic actuators, which manipulate the relative location of select components or devices of the equipment to perform various operations. For example, loaders may be utilized in lifting and moving various materials. A loader may include a bucket or fork attachment pivotally coupled by a boom to a frame. One or more hydraulic cylinders are coupled to the boom and/or the bucket to move the bucket between positions relative to the frame.

SUMMARY

According to an exemplary embodiment a work machine includes a rear body section and a front body section pivotally coupled to the rear body section. An articulation angle is defined by the relative angle between the front body section and the rear body section. An articulation actuator is coupled to the rear body section and the front body section. The articulation actuator is configured to pivot the front body section relative to the rear body section through an articulation angle range. A mechanical arm is coupled to the front body section. A work implement is coupled to the mechanical arm and is configured to receive a load. An arm actuator is coupled to the mechanical arm to move the mechanical arm between a lower position and an upper position. A distance between the lower position and the upper position defines a travel distance of the mechanical arm. A sensor system includes a load sensor, an arm position sensor, and an articulation angle sensor. A controller is in communication with the sensor system. The controller is configured to receive a movement command and to receive a set of values from the sensor system. The controller is configured to determine an operational window for normal operation of the work vehicle based on the received set of values, determine a movement limit based on the received set of values, and limit movement of a component beyond the movement limit.

According to another exemplary embodiment, a control system for a work machine includes a sensor system having a load sensor, an arm position sensor, and an articulation angle sensor. A controller is in communication with the sensor system. The controller is configured to receive a movement command and to receive a set of values from the sensor system. The controller is configured to determine an operational window for normal operation of the work vehicle based on the received set of values, determine a movement limit based on the received set of values, and limit movement of a component beyond the movement limit.

Another exemplary embodiment includes a method of controlling stability during operation of a work vehicle. An operator command is received for movement of a work vehicle actuator. A set of values is received from a sensor unit, wherein the set of values represents at least two of a load value, a height value, and an articulation angle value. An operational window is determined for normal operation of the work vehicle based on the received set of values. A movement limit is determined based on the received set of values. Movement of the work vehicle actuator is limited beyond the movement limit.

BRIEF DESCRIPTION OF THE DRAWINGS

The aspects and features of various exemplary embodiments will be more apparent from the description of those exemplary embodiments taken with reference to the accompanying drawings, in which.

DETAILED DESCRIPTION OF EXEMPLARY EMBODIMENTS

FIGS. 1-5 illustrate an exemplary embodiment of a work machine depicted as a loader 10. The present disclosure is not limited, however, to a loader and may extend to other industrial machines such as an excavator, crawler, harvester, skidder, backhoe, feller buncher, motor grader, or any other work machine. As such, while the figures and forthcoming description may relate to an loader, it is to be understood that the scope of the present disclosure extends beyond a loader and, where applicable, the term "machine" or "work machine" will be used instead. The term "machine" or "work machine" is intended to be broader and encompass other vehicles besides a loader for purposes of this disclosure.

Figure 1:
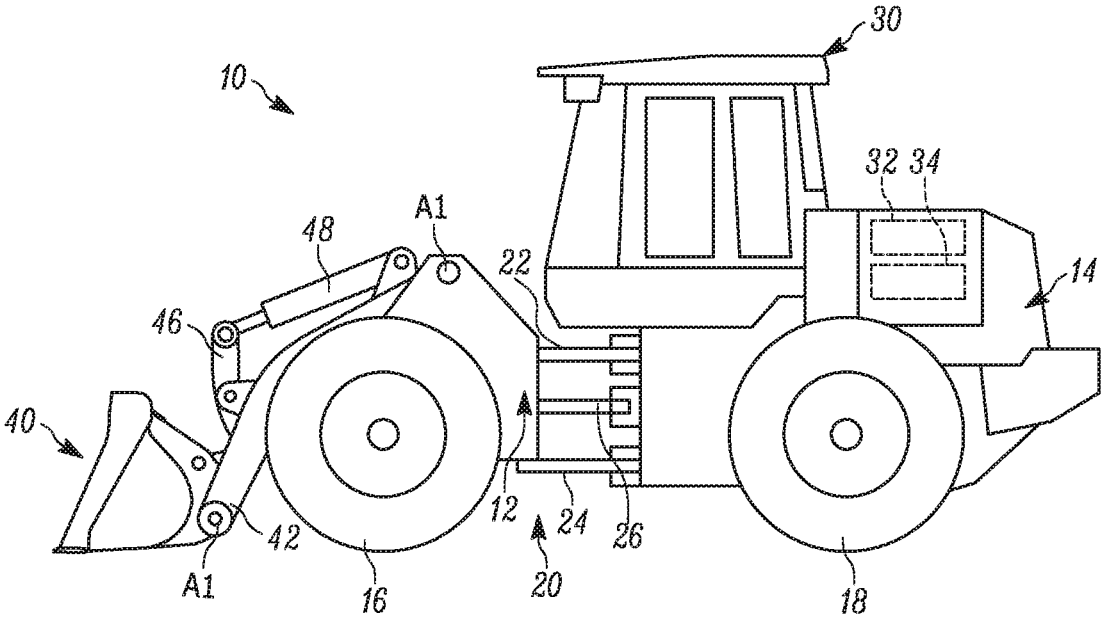
FIG. 1 is a side view of an exemplary work machine with a work implement in a lowered position.
Figure 2:
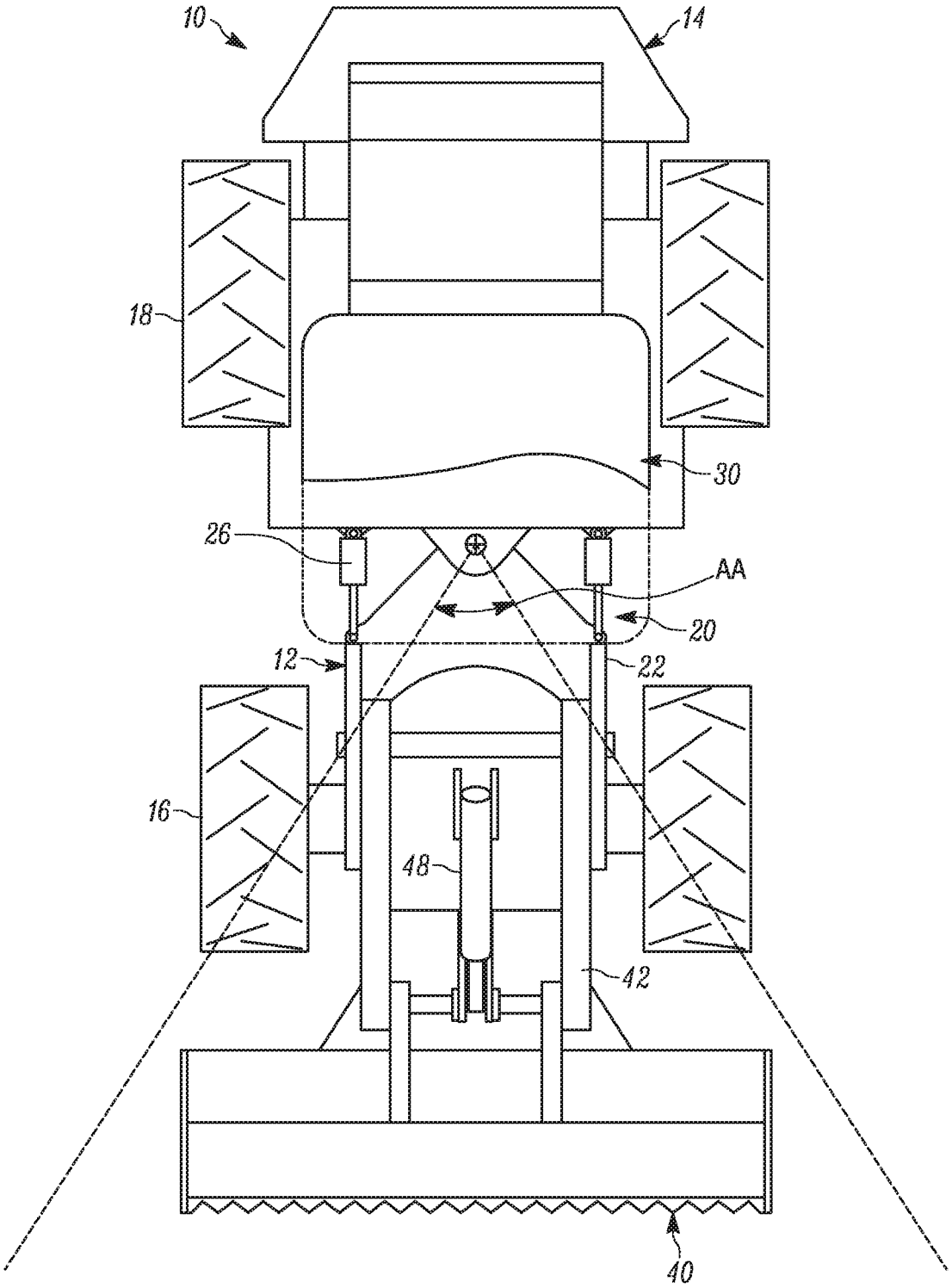
FIG. 2 is a top view of the work machine of FIG. 1.

FIGS. 1 and 2 show a wheel loader 10 having a front body section 12 with a front frame and a rear body section 14 with a rear frame. The front body section 12 includes a set of front wheels 16 and the rear body section 14 includes a set of rear wheels 18, with one front wheel 16 and one rear wheel 18 positioned on each side of the loader 10. Different embodiments can include different ground engaging members, such as treads or tracks.

The front and rear body sections 12, 14 are connected to each other by an articulation connection 20 so the front and rear body sections 12, 14 can pivot in relation to each other through an articulation angle AA range (orthogonal to the direction of travel and the wheel axis), for example between plus and minus 40 degrees from the centerpoint where the front section 12 is aligned with the rear section 14. The articulation connection 20 includes one or more upper connection arms 22, one or more lower connection arms 24, and a pair of articulation cylinders 26 (one shown), with one articulation cylinder 26 on each side of the loader 10 (e.g. left and right articulation cylinders). Pivoting movement of the front body 12 is achieved by extending and retracting the piston rods in the articulation cylinders 26.

The rear body section 14 includes an operator cab 30 in which the operator controls the loader 10. A control system (not shown) is positioned in the cab 30 and can include different combinations of a steering wheel, control levers, joysticks, control pedals, and control buttons. The operator can actuate one or more controls of the control system for purposes of operating movement of the loader 10 and the different loader components. The rear body section 14 also contains a prime mover 32 and a control system 34. The prime mover 32 can include an engine, such as a diesel engine and the control system 34 can include a vehicle control unit (VCU).

A work implement 40 is moveably connected to the front body section 12 by one or more boom arms 42. The work implement 40 is used for handling and/or moving objects or material. In the illustrated embodiment, the work implement 40 is depicted as a bucket, although other implements, such as a fork assembly, can also be used. A boom arm can be positioned on each side of the work implement 40. Only a single boom arm is shown in the provided side views and referred to herein as the boom 42. Various embodiments can include a single boom arm or more than two boom arms. The boom 42 is pivotably connected to the frame of the front body section 12 about a first pivot axis A1 and the work implement 40 is pivotably connected to the boom 42 about a second pivot Axis A2.

Figure 3:
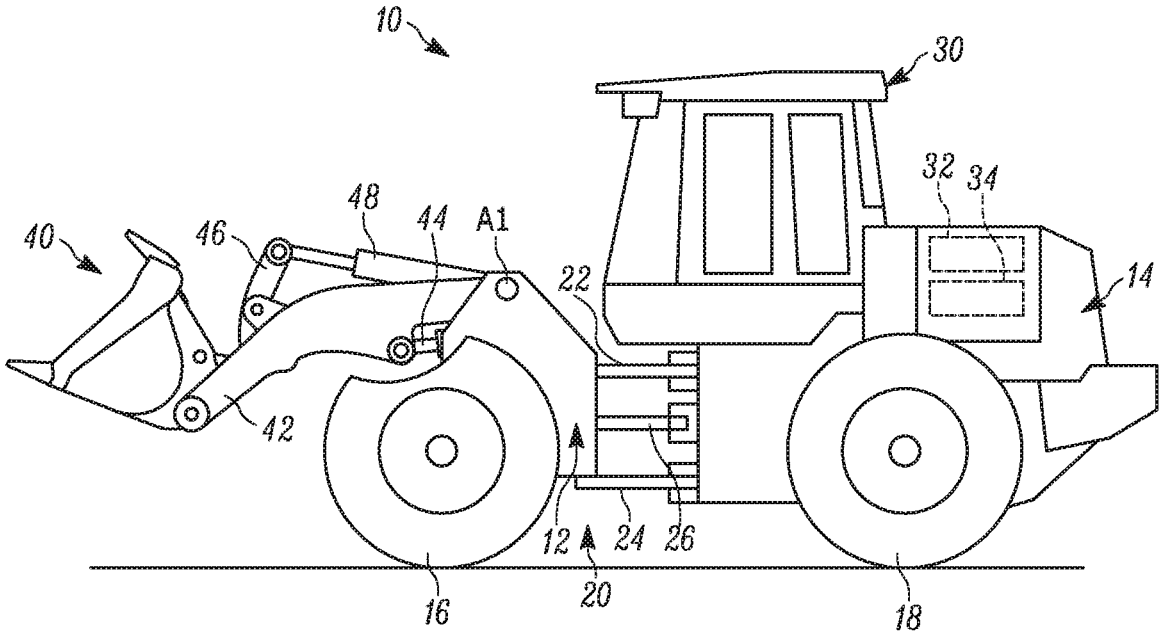
FIG. 3 is a side view of the work machine of FIG. 1 with the work implement in a partially raised position.
Figure 4:
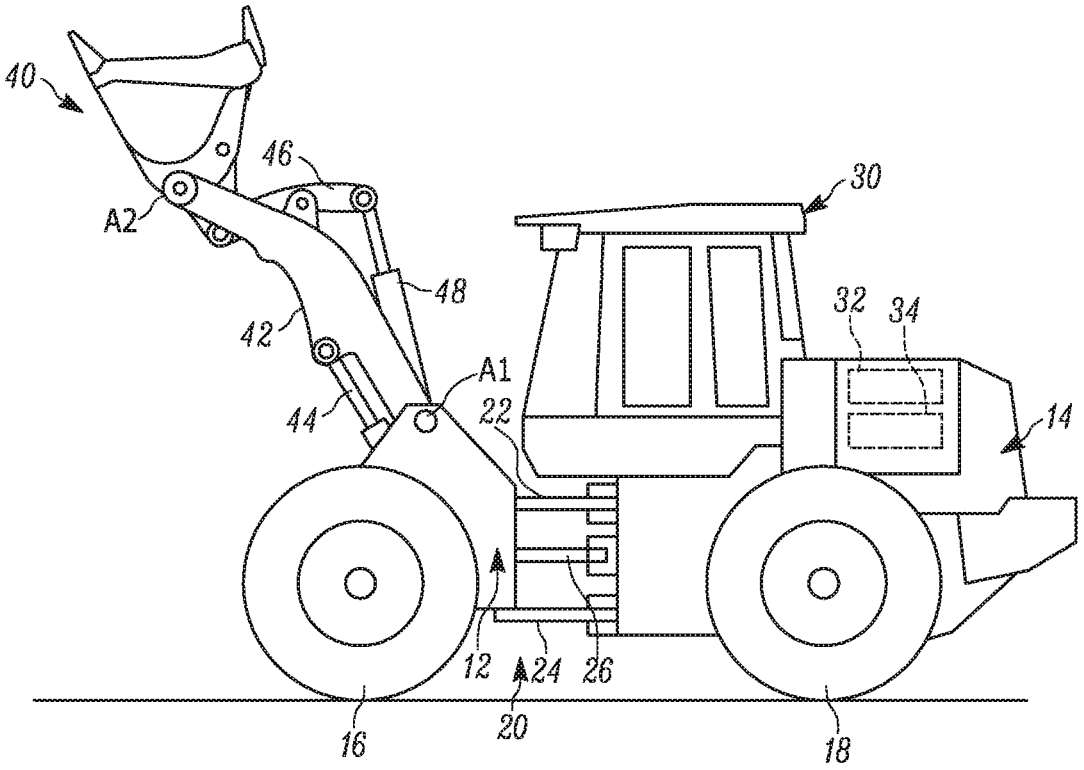
FIG. 4 is a side view of the work machine of FIG. 1 with the work implement in a fully raised position.
Figure 5:
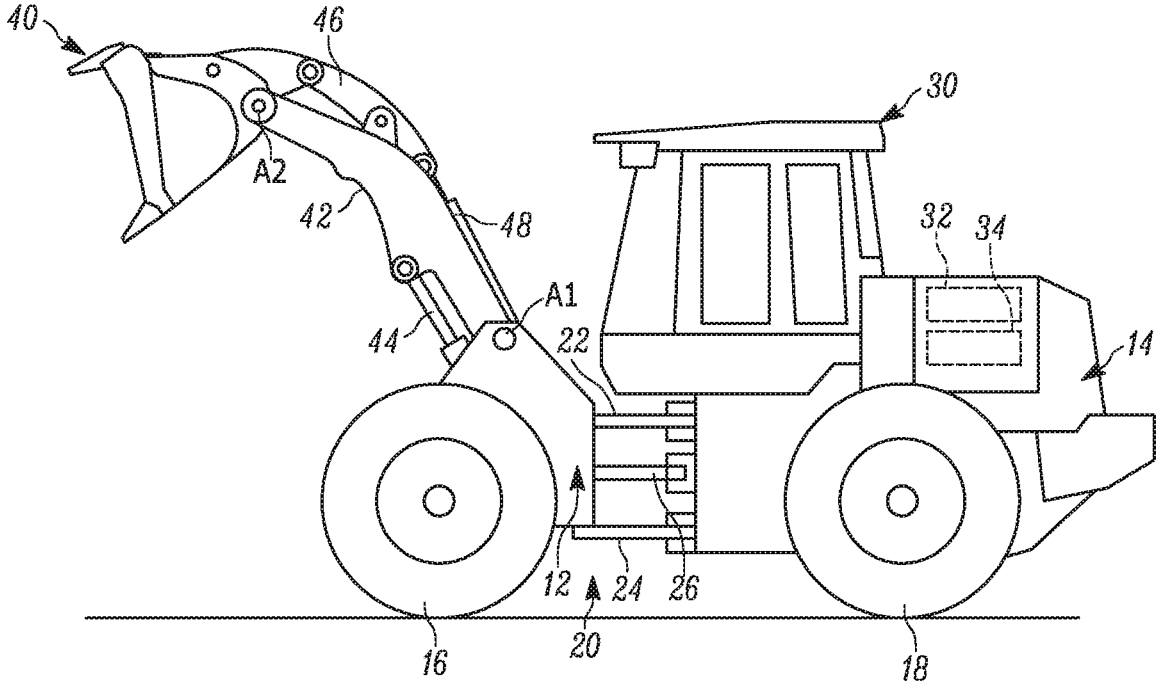
FIG. 5 is a side view of the work machine of FIG. 1 with the work implement in a fully raised and tilted position.

As best shown in FIGS. 3-5, one or more boom hydraulic cylinders 44 are mounted to the frame of the front body section 12 and connect to the boom 42. Generally, two hydraulic cylinders 44 are used with one on each side connected to each boom arm, although the loader 10 may have any number of boom hydraulic cylinders 44, such as one, three, four, etc. The boom hydraulic cylinders 44 can be extended or retracted to raise or lower the boom 42 to adjust the vertical position of the work implement 40 relative to the front body section 12.

One or more pivot linkages 46 are connected to the work implement 40 and to the boom 42. One or more pivot hydraulic cylinders 48 are mounted to the boom 42 and connect to a respective pivot linkage 46. Generally, two pivot hydraulic cylinders 48 are used with one on each side connected to each boom arm, although the loader 10 may have any number of pivot hydraulic cylinders 48. The pivot hydraulic cylinders 48 can be extended or retracted to rotate the work implement 40 about the second pivot axis A2, as shown, for example, in FIGS. 3 and 4. In some embodiments, the work implement 40 may be moved in different manners and a different number or configuration of hydraulic cylinders or other actuators may be used.

Figure 6:
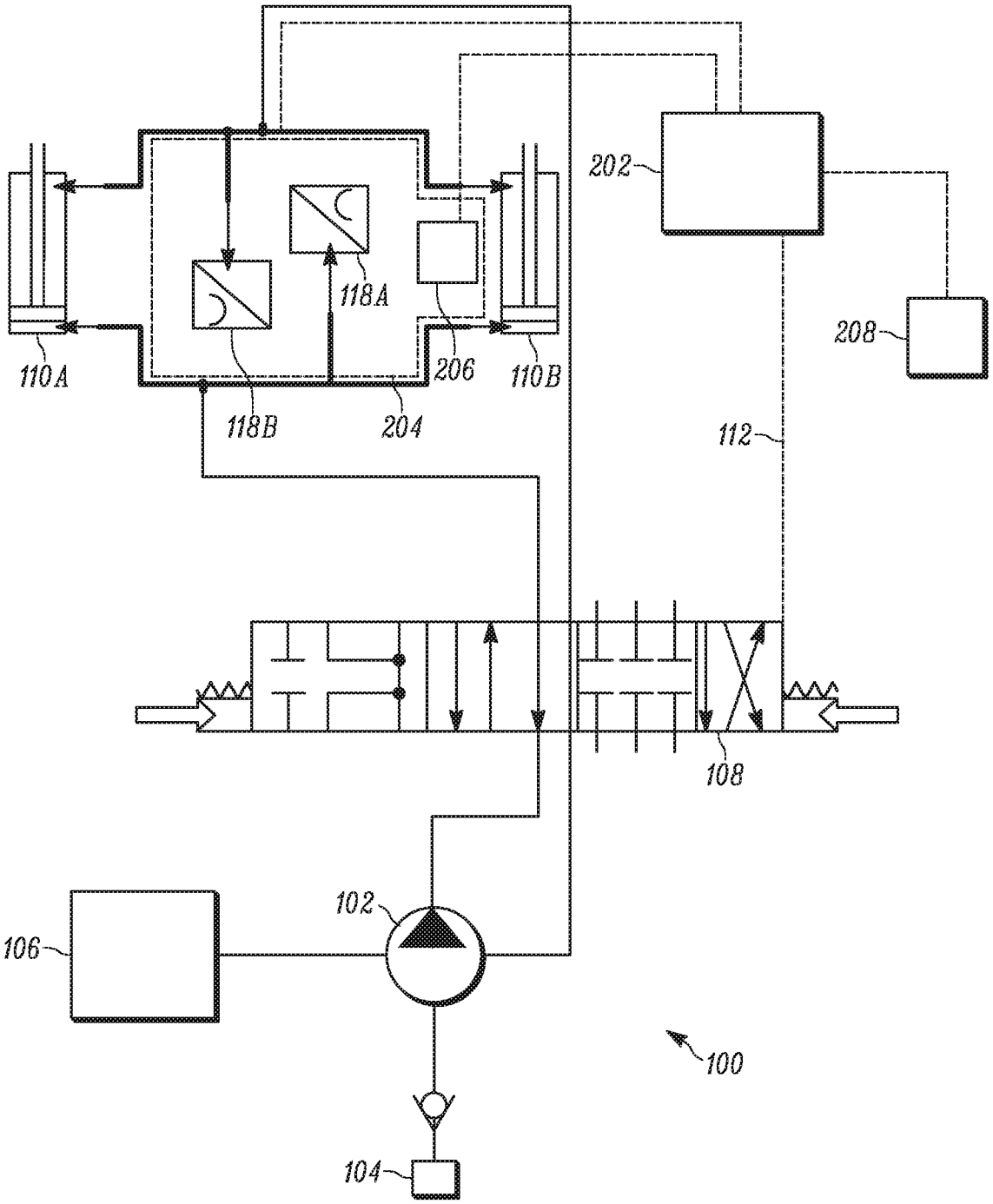
FIG. 6 is an exemplary hydraulic system schematic of the work vehicle of FIG. 1.

FIG. 6 illustrates a partial schematic of an exemplary embodiment of a hydraulic system 100 and control system 200 configured to supply fluid to implements in the loader 10 shown in FIGS. 1-5, although it can be adapted be used with other work machines as mentioned above. A basic layout of a portion of the hydraulic system 100 is shown for clarity and one of ordinary skill in the art will understand that different hydraulic, mechanical, and electrical components can be used depending on the machine and the moveable implements.

The hydraulic system 100 includes at least one pump 102 that receives fluid, for example hydraulic oil, from a reservoir 104 and supplies fluid to one or more downstream components at a desired system pressure. The pump 102 is powered by an engine 106. The pump 102 can be capable of providing an adjustable output, for example a variable displacement pump or variable delivery pump. Although only a single pump 102 is shown, two or more pumps may be used depending on the requirements of the system and the work machine.

For simplicity, the illustrated embodiment depicts the pump 102 delivering fluid to a single valve 108. In an exemplary embodiment, the valve 108 is an electrohydraulic valve that receives hydraulic fluid from the pump and delivers the hydraulic fluid to a pair of actuators 110A, 110B. The actuators 110A, 110B can be representative of the boom cylinders 44 shown in FIGS. 3-5, or may be any other suitable type of hydraulic actuator known to one of ordinary skill in the art. FIG. 6 shows an exemplary embodiment of two double-acting hydraulic actuators 110A, 110B. Each of the double-acting actuators 110A, 110B includes a first chamber and a second chamber. Fluid is selectively delivered to the first or second chamber by the associated valve 108 to extend or retract the actuator piston. The actuators 110A, 110B can be in fluid communication with the reservoir 104 so that fluid leaving the actuators 110A, 110B drains to the reservoir 104.

The hydraulic system 100 is in communication with a control system 200 (shown in more detail in FIG. 7) through a controller 202. In an exemplary embodiment, the controller 202 is a Vehicle Control Unit ("VCU") although other suitable controllers can also be used. The controller 202 includes a plurality of inputs and outputs that are used to receive and transmit information and commands to and from different components in the loader 10. Communication between the controller 202 and the different components can be accomplished through a CAN bus, other communication link (e.g., wireless transceivers), or through a direct connection. Other conventional communication protocols may include J1587 data bus, J1939 data bus, IESCAN data bus, etc.

The controller 202 includes memory for storing software, logic, algorithms, programs, a set of instructions, etc. for controlling the valve 108 and other components of the loader 10. The controller 202 also includes a processor for carrying out or executing the software, logic, algorithms, programs, set of instructions, etc. stored in the memory. The memory can store look-up tables, graphical representations of various functions, and other data or information for carrying out or executing the software, logic, algorithms, programs, set of instructions, etc.

The controller 202 is in communication with the valve 108 and can send a control signal 112 to the pump 102 to adjust the output or flowrate to the actuators 110A, 110B. The type of control signal and how the valve 108 is adjusted will vary dependent on the system. For example, the valve 108 can be an electrohydraulic servo valve that adjusts the flow rate of hydraulic fluid to the actuators 110A, 110B based on the received control signal 112.

One or more sensor units 204 can be associated with the actuators 110A, 110B. The sensor unit 204 can detect information relating to the actuators 110A, 110B and provide the detected information to the controller 202. For example, one or more sensors can detect information relating to actuator position, cylinder pressure, fluid temperature, or movement speed of the actuators. Although described as a single unit related to the boom arm, the sensor unit 204 can encompass sensors positioned at any position within the work machine or associated with the work machine to detect or record operating information.

FIG. 5 shows an exemplary embodiment where the sensor unit 204 includes a first pressure sensor 118A in communication with the first chamber of the actuators 110A, 110B and a second pressure sensor 118B is in communication with the second chamber of the actuators 110A, 110B. The pressure sensors 118A, 118B are used to measure the load on the actuators 110A, 110B. In an exemplary embodiment, the pressure sensors 118A, 118B are pressure transducers.

FIG. 5 also shows a position sensor 206 associated with the sensor unit 204. The position sensor 206 is configured to detect or measure the position of the actuators 110A, 110B and transmit that information to the controller 202. The position data can indicate the height of the boom 42. In an exemplary embodiment, the position sensor 206 can be a rotary position sensor that measures the position of the boom 42. Instead of a rotary position sensor, one or more inertial measurement unit sensors can be used. The position sensor 206 can also be an in-cylinder position sensor that directly measures the position of the hydraulic piston in one or more of the actuators 110A, 110B. The position sensor 206 can also include a work implement position sensor to detect the position and tilt of the work implement 40. Although only a single unit is shown for the position sensor 206, it can represent one or more sensors, including the boom position sensor and the work implement position sensor. Additional sensors may be associated with the sensor unit 204 and one or more additional sensor units can be incorporated into the system 100.

The controller 202 is also in communication with one or more operator input mechanisms 208. The one or more operator input mechanisms 208 can include, for example, a joystick, throttle control mechanism, pedal, lever, switch, or other control mechanism. The operator input mechanisms 208 are located within the cab 30 of the loader 10 and can be used to control the position of the work implement 40 by adjusting the hydraulic actuators 110A, 110B.

Figure 7:
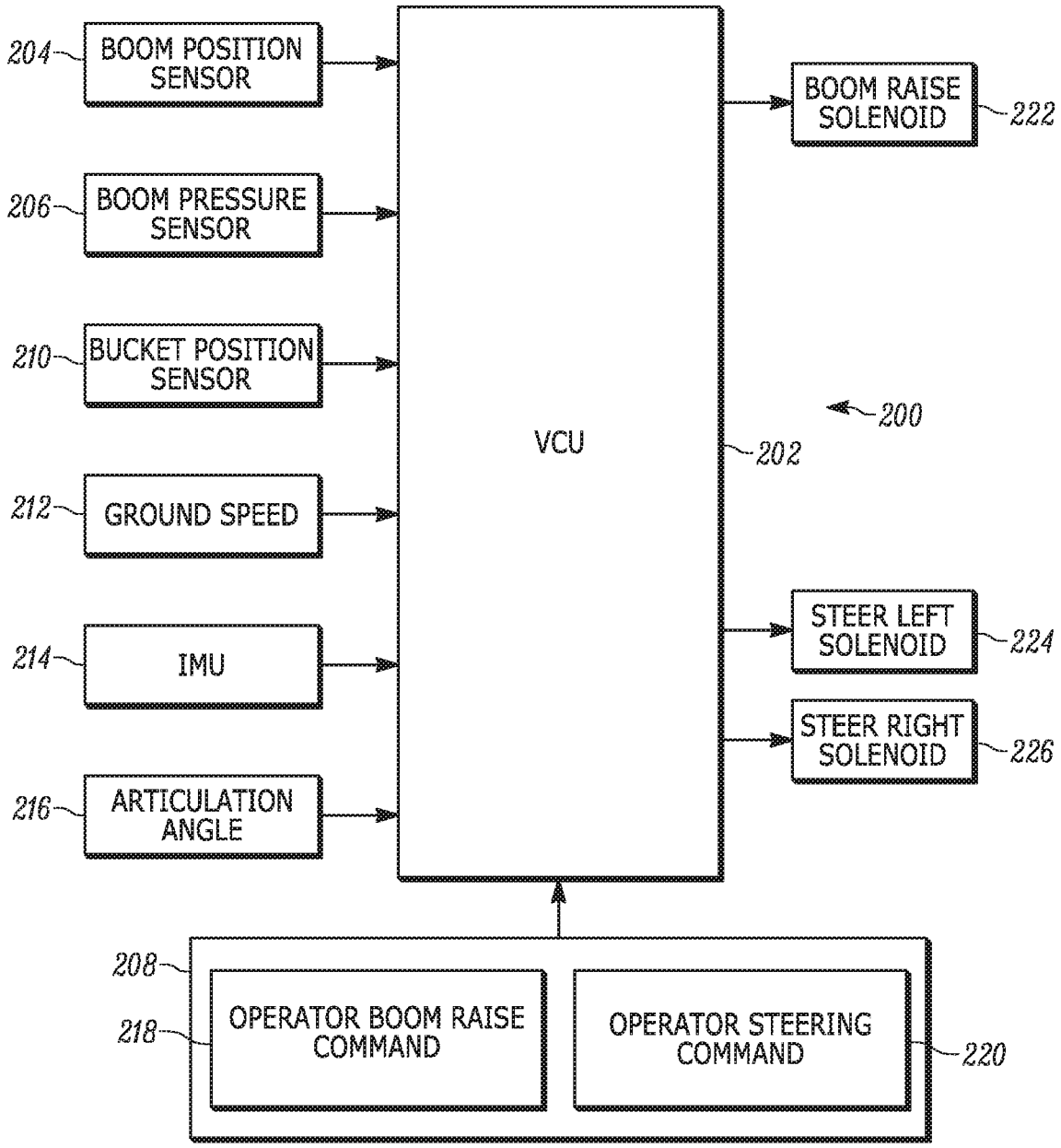
FIG. 7 is an exemplary control system schematic of the work vehicle of FIG. 1.

FIG. 7 illustrates a partial schematic of an exemplary embodiment of a control system 200 configured to monitor and control the operation of the loader 10 shown in FIGS. 1-5, although it can be adapted be used with other work machines as mentioned above. A basic layout of a portion of the control system 200 is shown for clarity and one of ordinary skill in the art will understand that components can be used depending on the machine and the moveable implements.

The control system 200 includes the controller 202 as discussed above that is connected to a plurality of sensors. The sensors include the boom position sensor 204 and the boom pressure sensor 206 shown in FIG. 6. A number of other sensors provide information to controller 202, including a bucket position sensor 210, a ground speed sensor 212, an inertial measurement unit 214, and an articulation angle sensor 216. The controller receives commands from the operator input mechanisms 208, for example an operator boom raise or lower command 218 which controls the height of the boom 42 or an operator steering command 220 which controls the articulation angle AA of the front body 12. The controller 202 transmits the boom raise and lower commands 218 to the boom raise solenoid 222. The steering commands 220 are transmitted to the steer left solenoid 224 and the steer right solenoid 226 to control the articulation angle AA.

During operation, an operator adjusts the position of the work implement 40 through manipulation of one or more input mechanisms 208. The operator is able to start and stop movement of the work implement 40, and also to control the movement speed of the work implement 40 through acceleration and deceleration. The movement speed of the work implement 40 is partially based on the flow rate of the hydraulic fluid entering the actuators 110A, 110B. The work implement's movement speed will also vary based on the load of the handled material. Raising or lowering an empty bucket can have an initial or standard speed, but when raising or lowering a bucket full of gravel, or a fork supporting a load of lumber, the movement speed of the bucket will be reduced or increased based on the weight of the material.

Stability is a concern during operation of a work machine 10, such as a loader. Instability can be caused by a load being supported by the work implement in a raised position. For example, a heavier load raised to the highest position of the boom arm 42 can increase the likelihood of the work machine tipping forward. This load instability can be increased by movement of the vehicle in the forward or reverse direction. Instability can also be caused when a load is supported at angle, for example causing the work machine to tip to the side. For example, the greater the articulation angle in either the positive or negative direction, the greater the rate of instability.

According to an exemplary embodiment, the control system 200 is configured to increase the stability of the vehicle during operation by limiting the boom height based on the articulation angle and load, limiting the articulation angle based on the load and boom height, or a combination of both.

Figure 8:
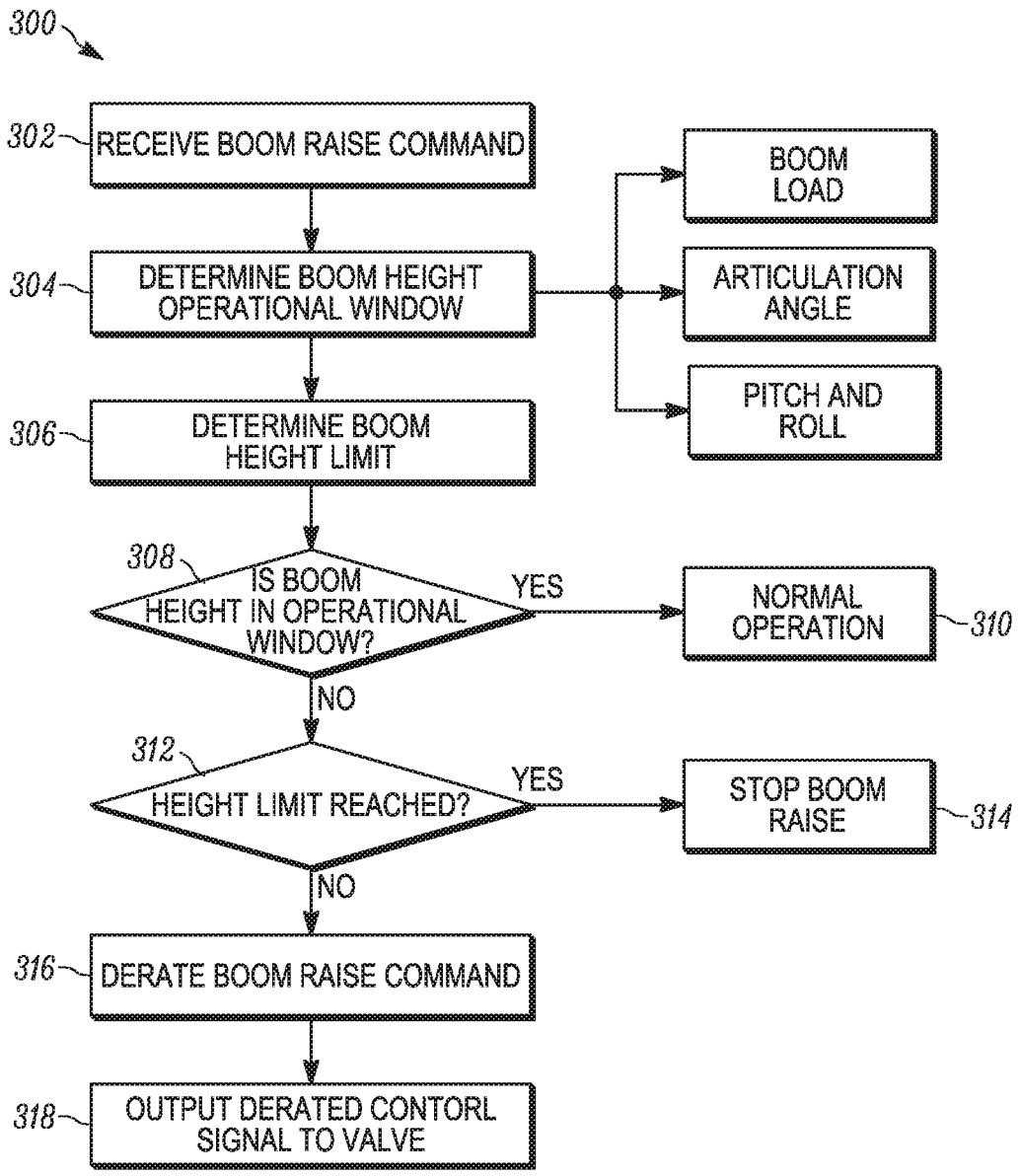
FIG. 8 is a flow chart for an exemplary height stability control system of the work vehicle of FIG. 1.

FIG. 8 shows a partial flow diagram of the instructions to be executed by the controller 202 for a boom height stability control system 300. Typically, when a boom raise command is received by the controller 202, the controller 202 sends a control signal 112 to the valve 108 to supply fluid to the second chamber of the actuators 110A, 110B, extending the hydraulic pistons. The flow rate of the hydraulic fluid can be based on the force or position of the operator's input, or based on a set rate.

The controller 112 initially receives a boom raise command (step 302) and determines an operational window (step 304) and a boom height limit (step 306) based on the boom load and the articulation angle AA received, for example, from the boom pressure sensor 206 and the articulation angle sensor 216, respectively. In some embodiments, the operational window and height limit can be further modified based on the pitch and roll of the machine determined, for example, by the inertial measurement unit 214. For example, the inertial measurement unit 214 can be used to determine when the machine is on off level conditions, such as a side slope, a ramp, or a combination of the two and reduce the operational window and height limit to increase the stability of the machine. The operational window and the height limit can be determined simultaneously or in any order.

Figure 9:
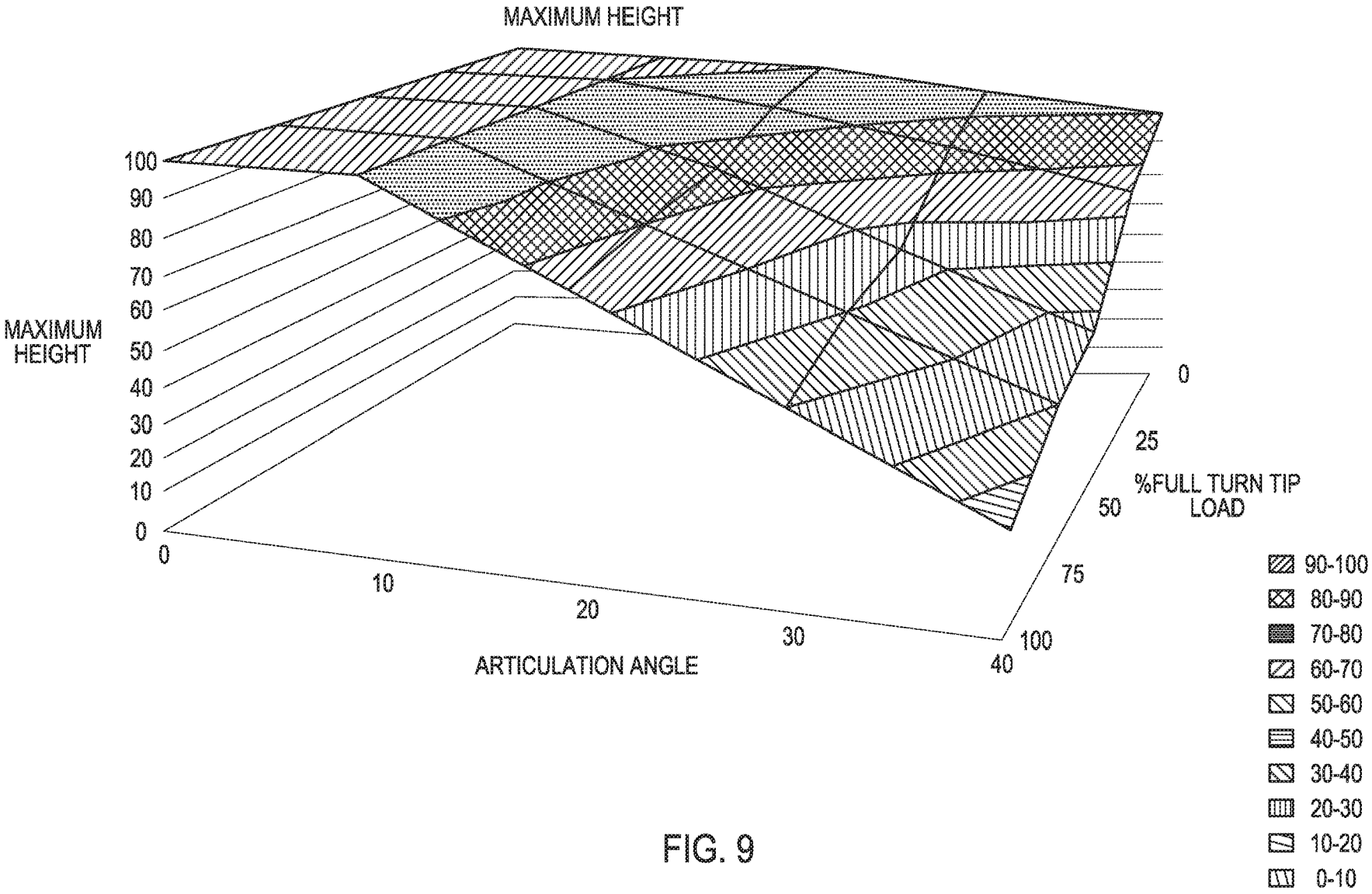
FIG. 9 is a 3-D graph of the maximum height versus the articulation angle and the load for the height stability control system.

If the boom height is within the operational window (step 308), the controller 202 proceeds under normal operation (step 310) and sends the control signal to the valve 108. If the height limit has been reached (step 312), the controller 202 stops the boom raise (step 314). The boom raise can be stopped by ignoring the raise command or by derating the flow from the valve 108 to the actuators 110A, 110B, so that there is no movement or movement is minimized. If the boom height is not within the operational window but the height limit has not been reached, then the controller 202 derates the boom raise command (step 316) and the derated control signal is sent to the valve (step 318). The derated control signal slows the movement speed of the boom. Between the operational window and the height limit, the controller 202 can derate the control signal a set amount, or the amount can increase as the boom height approaches the height limit. FIG. 9 shows a graph depicting an exemplary adjustment of the maximum height based on the load and articulation angle.

Figure 10:
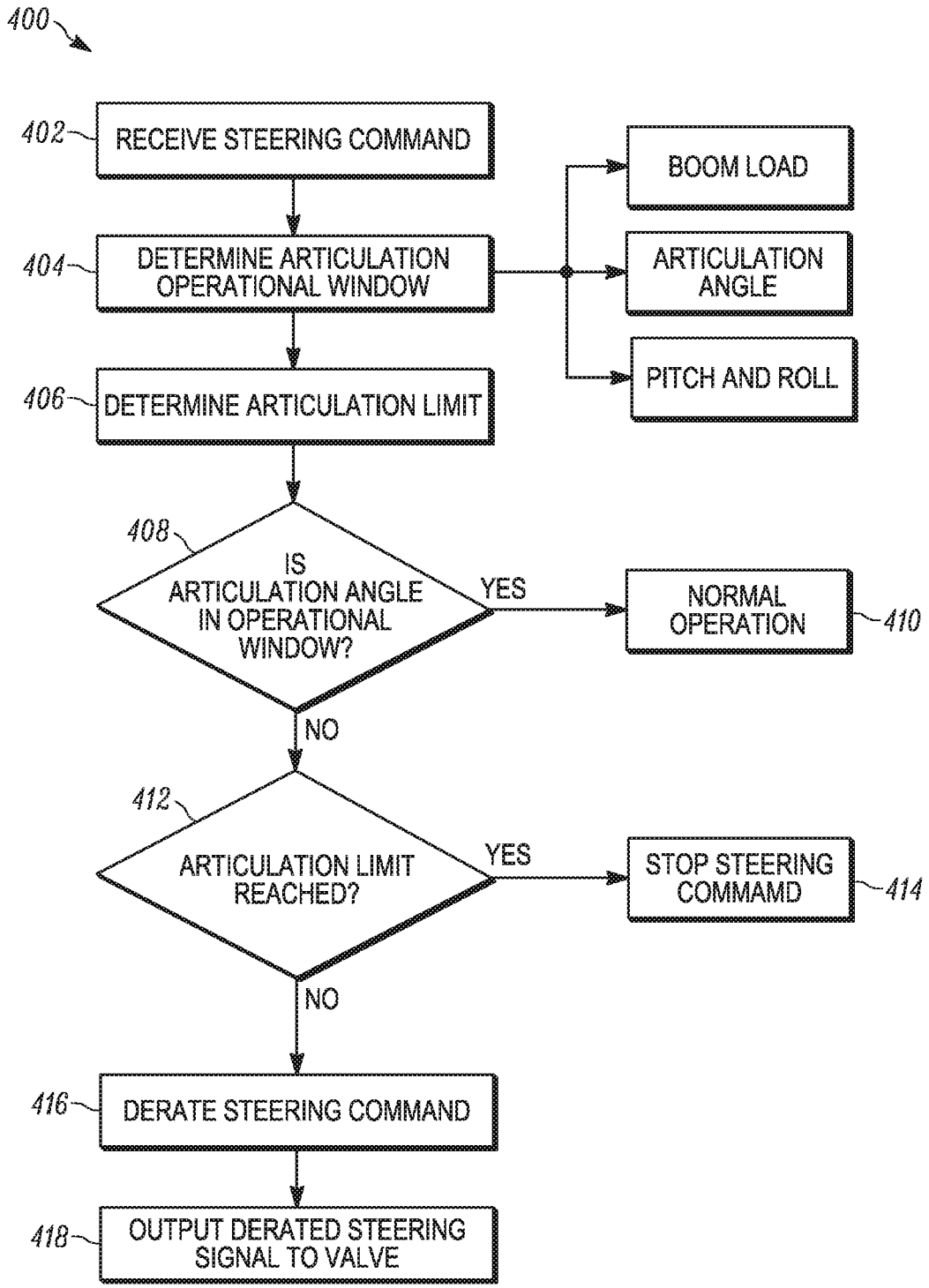
FIG. 10 is a flow chart for an exemplary articulation angle stability control system of the work vehicle of FIG. 1.

FIG. 10 shows a partial flow diagram of the instructions to be executed by the controller 202 for an articulation angle stability control system 400. Typically, when a steering command is received by the controller 202, the controller 202 sends a control signal to a valve to supply fluid to the articulation cylinders 26, for example through the steer left solenoid 224 and/or the steer right solenoid 226 to extend or retract the articulation cylinders 26 as needed. The flow rate of the hydraulic fluid can be based on the force or position of the operator's input, or based on a set rate.

The controller 112 initially receives a steering command (step 402) and determines an operational window (step 404) and an articulation angle limit (step 406) based on the boom load and the boom height received, for example, from the boom pressure sensor 206 and the boom position sensor 204, respectively. In some embodiments, the operational window and articulation limit can be further modified based on the pitch and roll of the machine determined, for example, by the inertial measurement unit 214. For example, the inertial measurement unit 214 can be used to determine when the machine is on off level conditions, such as a side slope, a ramp, or a combination of the two, and reduce the operational window and articulation limit to increase the stability of the machine. The operational window and the height limit can be determined simultaneously or in any order.

Figure 11:
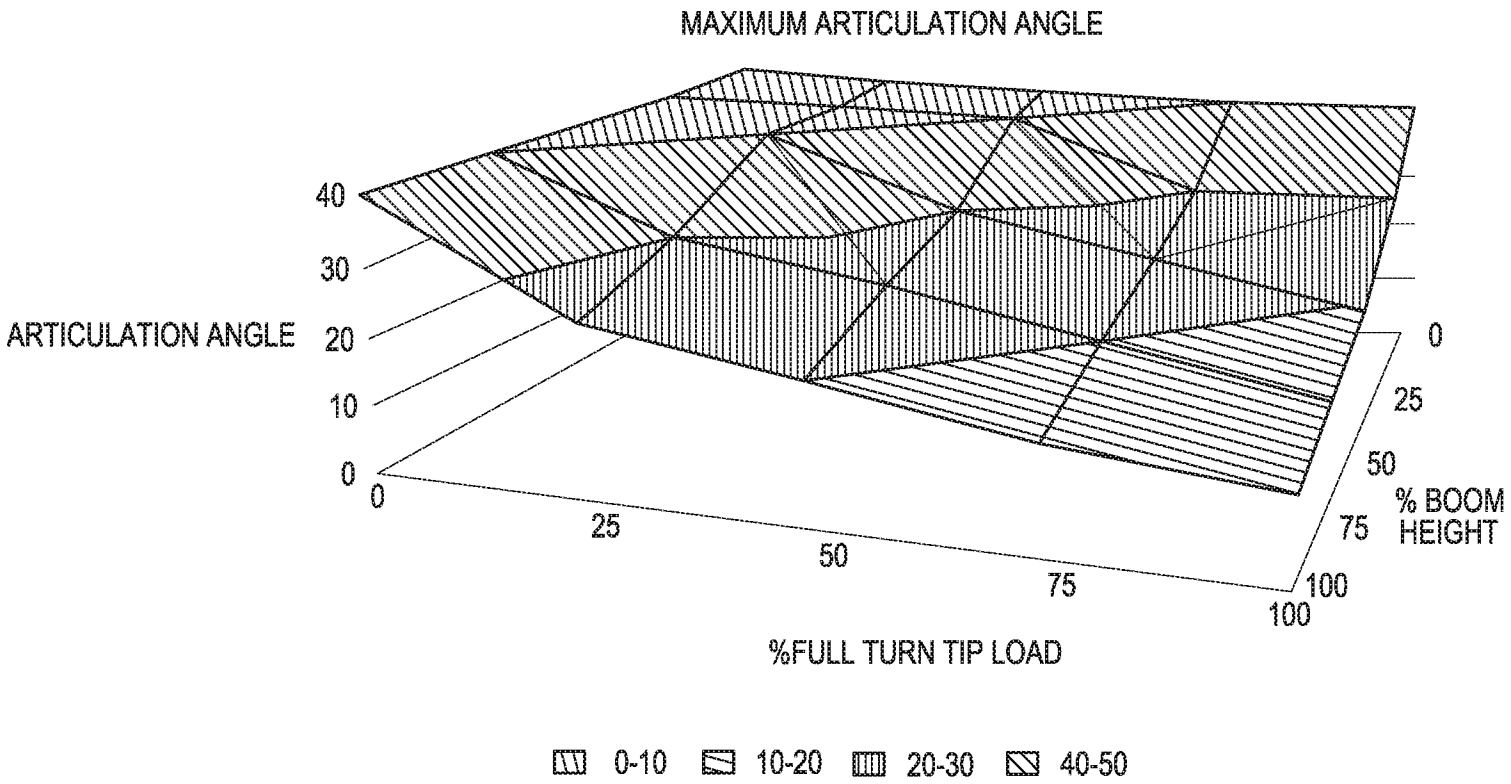
FIG. 11 is a 3-D graph of the maximum articulation angle versus load and boom height of the articulation angle stability control system.

If the articulation angle is within the operational window (step 408), the controller 202 proceeds under normal operation (step 410) and sends the control signal to the steering valve or valves. If the articulation limit has been reached (step 412), the controller 202 stops the steering command (step 414). The steering command can be stopped by ignoring the command or by derating the flow to the articulation actuators 26, so that there is no movement or movement is minimized. If the steering command is not within the operational window but the articulation limit has not been reached, then the controller 202 derates the steering command (step 416) and the derated control signal is sent to the valve (step 418). The derated control signal slows the movement speed of articulation cylinders 26. Between the operational window and the articulation limit, the controller 202 can derate the control signal a set amount, or the amount can increase as the articulation angle approaches the articulation limit. FIG. 11 shows a graph depicting an exemplary adjustment of the maximum articulation angle based on the load and boom height.

Figure 12:
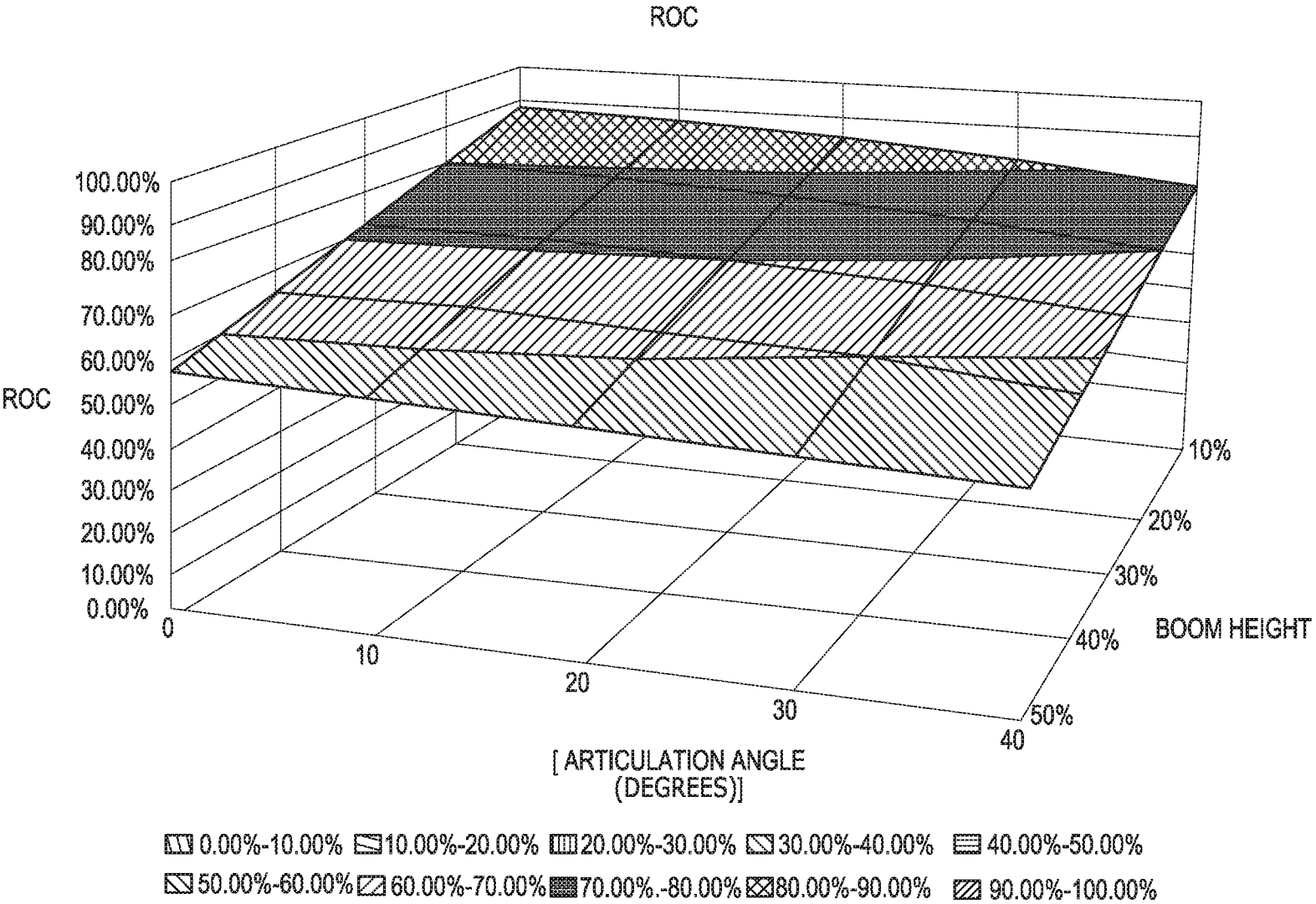
FIG. 12 is a 3-D graph showing the rated operating capacity of the work machine utilizing the height stability control system and the articulation angle stability control system.

The boom height stability control system 300 and the articulation angle stability control system 400 can be combined to define an operational window for the boom height and articulation angle of the work machine 10 to increase the stability during operation. The increase in stability can also increase the rated operating capacity for certain operations of the work machine 10 as shown in FIG. 12. Normally the machine would be rated at the bottom limit shown in FIG. 12 to ensure compliance with safe operations under all conditions. The increased stability allows the machine to be rated higher and will automatically limit the height and articulation angle at higher loads to ensure safe operation.

The foregoing detailed description of the certain exemplary embodiments has been provided for the purpose of explaining the general principles and practical application, thereby enabling others skilled in the art to understand the disclosure for various embodiments and with various modifications as are suited to the particular use contemplated. This description is not necessarily intended to be exhaustive or to limit the disclosure to the exemplary embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present disclosure, and are not intended to limit the structure of the exemplary embodiments of the present disclosure to any particular position or orientation. Terms of degree, such as "substantially" or "approximately" are understood by those of ordinary skill to refer to reasonable ranges outside of the given value, for example, general tolerances or resolutions associated with manufacturing, assembly, and use of the described embodiments and components.

What is claimed:

1. A work machine comprising:

a rear body section;

a front body section pivotally coupled to the rear body section, wherein an articulation angle is defined by the relative angle between the front body section and the rear body section;

an articulation actuator coupled to the rear body section and the front body section, the articulation actuator configured to pivot the front body section relative to the rear body section through an articulation angle range;

a mechanical arm coupled to the front body section;

a work implement coupled to the mechanical arm, the work implement configured to receive a load;

an arm actuator coupled to the mechanical arm to move the mechanical arm between a lower position and an upper position, wherein a distance between the lower position and the upper position is a travel distance of the mechanical arm;

a sensor system including a load sensor, an arm position sensor, and an articulation angle sensor; and a controller in communication with the sensor system, wherein the controller is configured to receive a movement command and to receive a set of values from the sensor system including a load value, an arm position value, and an articulation angle value, wherein the controller is configured to determine an operational window for normal operation of the work vehicle based on the received set of values, determine a movement limit based on the received set of values, limit movement of a component beyond the movement limit, and derate movement of the component between the operational window and the movement limit a continuously increasing amount between the operational window and the movement limit.

2. The work machine of claim 1, wherein the controller is in communication with a valve that supplies fluid to the component.

3. The work machine of claim 2, wherein derating movement of the component includes decreasing a flow from the valve to an actuator connected to the component.

4. The work machine of claim 1, wherein the movement command is a boom raise command and the movement limit is a boom height limit.

5. The work machine of claim 4, wherein the operational window and the boom height limit are determined based on the load value and the articulation angle value.

6. The work machine of claim 5, wherein the controller is configured to determine an articulation angle limit of the front body section based on the load and the mechanical arm position, and configured to limit the front body section from pivoting past the articulation angle limit.

7. The work machine of claim 1, wherein the movement command is a steering command and the movement limit is an articulation angle limit.

8. The work machine of claim 7, wherein the operational window and the articulation angle limit are determined based on the load value and the arm height value.

9. The work machine of claim 1, wherein the sensor system includes an inertial measurement unit configured to measure a pitch and a roll of the front body section, and wherein the controller is configured to further determine the operational window and the movement limit based on an amount of pitch and roll.

10. The work machine of claim 1, wherein the arm actuator is a hydraulic actuator and the controller is in communication with a valve that supplies fluid to the arm actuator.

11. The work machine of claim 1, wherein the articulation actuator is a hydraulic actuator and the controller is in communication with a valve that supplies fluid to the articulation actuator.

12. A method of controlling stability during operation of a work vehicle, the method comprising:

receiving an operator command for movement of a work vehicle actuator;

receiving a set of values from a sensor unit, wherein the set of values represents at least two of a load value, a height value, and an articulation angle value;

determining an operational window for normal operation of the work vehicle based on the received set of values;

determining a movement limit based on the received set of values;

limiting movement of the work vehicle actuator beyond the movement limit; and derating the actuator movement a continuously increasing amount between the operational window and the movement limit.

13. The method of claim 12, wherein the operator command is a boom raise command and the movement limit is a boom height limit.

14. The method of claim 13, wherein the operational window and the boom height limit are determined based on the load value and the articulation angle value.

15. The method of claim 12, wherein the movement command is a steering command and the movement limit is an articulation angle limit.

16. The method of claim 15, wherein the operational window and the articulation angle limit are determined based on the load value and the height value.

17. The method of claim 12, wherein the set of values includes an inertial measurement value, and wherein the controller is configured to further determine the operational window and the movement limit based on the inertial measurement value.

18. The method of claim 12, wherein the work vehicle actuator is a hydraulic actuator and the controller is in communication with a valve that supplies fluid to the work vehicle actuator.

19. A work machine comprising:

a rear body section;

a front body section pivotally coupled to the rear body section, wherein an articulation angle is defined by the relative angle between the front body section and the rear body section;

an articulation actuator coupled to the rear body section and the front body section, the articulation actuator configured to pivot the front body section relative to the rear body section through an articulation angle range;

a mechanical arm coupled to the front body section;

a work implement coupled to the mechanical arm, the work implement configured to receive a load;

an arm actuator coupled to the mechanical arm to move the mechanical arm between a lower position and an upper position, wherein a distance between the lower position and the upper position is a travel distance of the mechanical arm;

a sensor system including a load sensor, an arm position sensor, and an articulation angle sensor; and a controller in communication with the sensor system, wherein the controller is configured to receive a first movement command for the articulation actuator, and to receive a set of values from the sensor system including a load value, an arm position value, and an articulation angle value, and wherein the controller is configured to determine a first operational window for normal operation of the articulation actuator based on the received set of values, determine an articulation movement limit based on the received set of values, limit movement of the articulation actuator beyond the articulation movement limit, and derate movement of the articulation actuator between the first operational window and the articulation movement limit a continuously increasing amount between the operational window and the movement limit.

20. The work machine of claim 19, wherein the controller is further configured to determine a second operational window for normal operation of the arm actuator based on the received set of values, determine an arm movement limit based on the received set of values, limit movement of the arm actuator beyond the arm movement limit, and derate movement of the arm actuator between the second operational window and the arm movement limit a variable amount, and wherein the variable amount increases approaching the arm movement limit.

* * * * *